United States Patent [19]

Fujimoro et al.

[11] 4,087,924

[45] May 9, 1978

[54] ROTARY-TYPE SLICE DRYER

[75] Inventors: Keizo Fujimoro; Shigeharu Ohara, both of Tokyo, Japan

[73] Assignee: Nippon Electric Co., Ltd., Tokyo, Japan

[21] Appl. No.: 792,993

[22] Filed: May 2, 1977

[30] Foreign Application Priority Data

May 8, 1976 Japan ..... 51-52336

[51] Int. Cl.[2] ..... F26B 17/24

[52] U.S. Cl. ..... 34/58; 210/512 R; 233/22

[58] Field of Search ..... 34/53, 55, 58; 210/368, 210/512; 233/16, 21, 22

[56] References Cited

U.S. PATENT DOCUMENTS 3,014,642 12/1961 Lundberg ..... 233/22

3,092,582 6/1963 Lacker ..... 233/22 X

*Primary Examiner*—Harold W. Weakley

*Attorney, Agent, or Firm*—Hopgood, Calimafde, Kalil, Blaustein & Lieberman

[57] ABSTRACT

A rotary-type dryer for use in drying slices such as semiconductor wafers includes a rotatable basket for accommodating the slices to be dried. A plurality of blades are arranged in a circle concentric with the axis of rotation of the basket. The blades are disposed at an angle relative to the tangential direction of the circle. A case is provided outside the blades and the basket and includes an air-and-liquid exhaust port. An air intake port allows drying air to be introduced into the basket.

8 Claims, 3 Drawing Figures

ROTARY-TYPE SLICE DRYER

The present invention relates to a rotary-type dryer for slices, which has particular utility in the drying of slices, such as semiconductor wafers, in which a high degree of cleanliness is highly required.

In prior art dryers, a plurality of slices such as semiconductor wafers are placed in a standing position and are arranged radially in a basket which is, in turn, charged in a case provided with an inflow port and an outflow port for dry air. The semiconductor wafers are dried by rotating the basket while introducing dry air into the case. The dry air is introduced from a location above the basket and is exhausted externally from a position below the basket for the purpose of uniformly drying the wafers. However, the introduced dry air forms an eddy in the case, which causes water drops, particles of cleaning liquid, and dust that were previously removed from the semiconductor wafers and dust or the like on the case and on the basket to once again adhere to the wafers. Consequently, the prior art dryers do not achieve the high cleanliness of surfaces of semiconductor wafers and moreover, the known dryers require a prolonged drying time.

It is, therefore, an object of the present invention to provide a rotary-type slice dryer which gives a high degree of cleanliness to the surfaces of the slices being dried. It is a further object of the invention to provide a slice dryer of the type described in which the slices can be dried in a relatively short period of time.

According to the present invention, there is provided a slice dryer comprising a rotatable basket adapted to support slices in a radial arrangement, means for rotating the basket, a case surrounding the basket and provided with a dry air inflow port above the center of rotation of the basket and with an air outflow near the side of the basket in the tangential direction of rotation of the basket, and a plurality of blades disposed between the side wall of the case and the basket and arranged so as to surround the basket at a predetermined angle of between 0° and 40° with respect to the tangential direction of rotation.

In the slice dryer of the invention, the introduced dry air, after removing water drops, cleaning liquid, and dust from the surfaces of the slices, is forced to flow through gap spaces between the blades to the outside of the blades and to be exhausted directly through the outflow port. The air having flowed out to the outside of the blades cannot re-enter into the inside of the blades, but instead forms an air flow flowing along the side wall of the case. The smooth flow of the dry air from the blades and the prevention of the re-entry of the exhausted dry air into the basket are achieved by the suitable selection of the angle of the blades. Accordingly, water drops, cleaning liquid, dust, and the like which have once been removed from the slices cannot again adhere to the slices, and dust and the like that adhered to the case or the basket are not transferred onto the slices. Therefore, the time required for drying the slices can be shortened and the surface cleanliness of the slices is maintained.

The above and other objects and features of the invention will become apparent from the following description taken in conjunction with the accompanying drawing; wherein.

Figure 1:
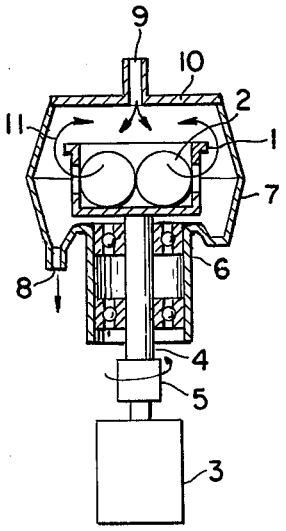
(PRIOR ART) FIG. 1
FIG. 1 is a cross-sectional view of a prior art dryer for semiconductor wafers.

Referring to FIG. 1, a prior art dryer comprises a basket 1 accommodating a large number of semiconductor wafers 2 which have previously been subjected to a cleaning treatment. The basket 1 is mounted on a rotary shaft 4 which is, in turn, rotated via a shaft coupling 5 by means of a motor 3. The basket 1 is freely rotated relative to the case 7 surrounding the basket 1 by the intermediary of bearings 6 which support the rotary shaft 4. Above the basket 1 is formed a lid 10 that is provided with an air intake port 9.

After a large number of previously cleaned wafers 2 are placed in the basket in a standing position and in a radial arrangement, the basket 1 is rotated at a high speed of 2000 to 3000 r.p.m. and clean and dry air is introduced through the air intake port 9 and is then exhausted through an air exhaust port 8, which also serves as a liquid exhaust port. Then, dust or the like, which adhered onto the wafers 2, as well as cleaning liquid is dispersed in a form of spray, so that the surfaces of the wafers can be dried while dust or the like is removed from these surfaces.

However, in practice, the prior art dryer has the following disadvantages. First, while the clean and dry air introduced into the case during rotation of the basket 1 flows out of the case 7 through the liquid-and air-exhaust port 8, the introduced air flows in the case 7 as indicated by the arrows and forms eddies. Moreover, after the cleaning liquid, dust, and the like dispersed from the wafers 2 strike against the inner side wall of the case 7, a part thereof is spattered back together with dust which adhered onto the side wall, and the other part circulates along paths of circulation indicated by the arrows. As a result, the cleaning liquid, dust and the like that were previously dispersed once again adhere onto the surfaces of the wafers, which results in their contamination. In addition prior art dryers of this type typically employ a D.C. motor, which took a considerable time until it reached an operating rotational speed of e.g., 2000 to 3000 r.p.m. Before that time, the centrifugal forces exerted upon the cleaning liquid, dust or the like remaining on the surfaces of the wafers were too small, and the motor was required to rotate for a long period.

Figure 2:
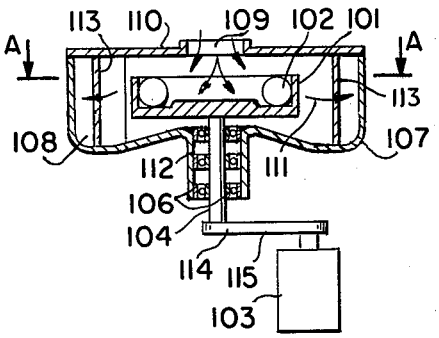
FIG. 2 is a cross-sectional view showing a dryer for semiconductor wafers according to one preferrd embodiment of the present invention.
Figure 3:
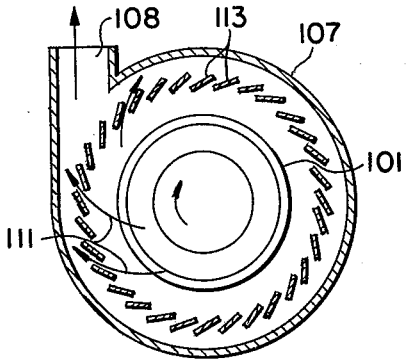
FIG. 3 is a cross-sectional plan view taken along line A-A in FIG. 2.

Referring to the embodiment of the invention illustrated in FIGS. 2 and 3, the rotation of a motor 103 is transmitted through a belt 115 to a pulley 114 to a rotary shaft 104. A case 107 supports the rotary shaft 104 in a freely rotatable manner by the intermediary of bearings 106. A basket 101 is provided at the top of the rotary shaft 104, in which a large number of semiconductor wafers 102 to be dried are disposed in a standing position and in a radial arrangement. A large number of blades 113 are provided between the case 107 and the basket 101, so that the blades 113 encircle the basket 101. The blades 113 are arranged along a circle that is concentric with the axis of rotation of the basket 101 and each of the blades is disposed at an angle of between 0° and 40° relative to a line that is tangential to the circumference of the basket 101 as directed in the direction of rotation of the basket, as indicated by the arrow in FIG. 3. By way of example, this angle may be 30°. The case 107 is provided with an air- and liquid-exhaust port 108 which, as seen best in FIG. 3, is aligned, or in parallel with, a line tangent to the circumference of the basket 101 as directed in the direction of rotation of the basket. A lid 110 (FIG. 2) is provided at the top of the case 107 and has an air intake port 109 formed therein above the center of rotation of the basket 101. Clean and dry air is introduced through the air intake port 109 into the case 107 down to the basket 101 in the direction along the axis of rotation of the basket 101. This air flows out of the blades 113 along air flow paths 111, and is finally exhausted through the air- and liquid-exhaust port 108. Owing to the provision of a seal member 112 between the case 107 and the rotary shaft 104, the air flow paths 111 never extend in the direction of the rotary shaft 104.

In operation, since the blades 113 are disposed on a circle concentric with the rotary shaft 104 and surround the basket 101 at an angle of between 0° and 40° such as, for example, 30°, with respect to the tangential direction of the circle as described above, the cleaning liquid, dust and the like dispersed from the surfaces of the wafers 102 by the centrifugal force never contaminate the wafer surfaces. In more detail, though the cleaning liquid, dust and the like once strike against the inner side surfaces of the blades 113, they are smoothly blown away from the inner side surfaces of the blades 113 towards the inner wall surface of the case 107 owing to the flow of air in the tangential direction which is generated by the rotation of the basket 101. The mist-like cleaning liquid and the like that strike against the inner wall surface of the case 107 are exhausted through the air- and liquid-exhaust port 108. At this time, the greater part of the mist-like cleaning liquid and the like flow along the inner wall surface of the case 107. However, these possible contaminants are not scattered back to the wafers 102 or to the basket 101 as a result of the presence of the blades 113.

In addition, the air and liquid can be smoothly exhausted through the air- and liquid-exhaust port 108 provided along the tangential direction of the case 107, and an air flow component circulating within the case 107 can be eliminated. Especially, an air flow component returning to the wafers 102 can be neglected, resulting in no recontamination of the wafer surfaces. It is necessary to select the cross-section of the air- and liquid-exhaust port 108 to be sufficiently large, because if it is too small, a reverse flow of air and liquid would not be prevented. By the use of the dryer of the invention, a high level of cleanliness of the surfaces of the dried semiconductor wafers is achieved. Further, since there is no circulating air flow and the introduced air can be directly and smoothly exhausted, the drying effect can be enhanced and the drying of the wafers can be finished within a relatively short period of time. Still further, in the event that some of the wafers 102 should crack during rotation, fragments of the cracked wafer would not flow reversely into the basket 101 owing to the existence of the blades 113, and thus these fragments would not hurt the other wafers in the basket.

It is desirable to use an induction motor as the rotary drive motor to speed up the acceleration of the basket up to the predetermined rotational speed. Owing to this construction, centrifugal forces exerted upon the cleaning liquid, dust and the like on the surfaces of the wafers increase quickly and thus quickly disperse these contaminants. The drying period can thus be shortened. Optimum operating rotational speed for effective drying would be between 900 and 1500 r.p.m.

While the invention has been described above in connection with a dryer for semiconductor wafers, dryer of the invention may also be used to advantage in other types of dryers, such as in centrifugal hydroextractors and in other dryers for use in applications that require clean surfaces of the objects to be dried.

As described above, in the slice dryer for semiconductor wafers and the like according to the present invention, by the provision of blades on a circle concentric with a rotary shaft encircling a basket at an angle of between 0° and 40° relative to a tangential direction of the circle, and an air- and liquid- exhaust port directed in a tangential direction of a side wall of a case, air exhaust is effected without back scattering of the cleaning liquid, dust and the like that are dispersed between the slices, and without a circulating air flow in the case. The slices can thus be dried to a high degree of cleanliness and the drying period can be shortened.

What is claimed is:

1. A slice dryer comprising a rotatable basket adapted to have disposed therein a plurality of slices to be dried, a plurality of blades arranged in a circle that is concentric with the axis of rotation of said basket and surrounding said basket, each of said plurality of blades being directed at an angle relative to the tangential direction of said circle, a case placed outside said plurality of blades and surrounding said blades and said basket, means for exhausting air and liquid provided on a side wall of said case, and means for introducing drying air into said case in a direction along the axis of rotation of said basket.

2. The slice dryer as claimed in claim 1, in which said blades are directed at an angle of between 0° and 40° relative to the tangential direction of rotation of said basket.

3. The slice dryer as claimed in claim 2, in which said air exhausting means includes an exhaust port aligned with the tangential line of the circumference of said basket.

4. The slice dryer as claimed in claim 3, in which said drying air introducing means comprises an intake port formed in said case and above, and in alignment with, the axis of rotation of said basket.

5. The slice dryer of claim 4, further comprising means including a rotatable shaft coupled to said basket for rotating said basket, and a seal member interposed between said case and said rotating shaft.

6. The slice dryer as claimed in claim 1, in which said air exhausting means includes an exhaust port aligned with the tangential line of the circumference of said basket.

7. The slice dryer as claimed in claim 6, in which said drying air-introducing means comprises an intake port formed in said case and above, and in alignment with, the axis of rotation of said basket.

8. The slice dryer of claim 1, further comprising means including a rotatable shaft coupled to said basket for rotating said basket, and a seal member interposed between said case and said rotating shaft.

* * * * *